US007705193B2

(12) United States Patent
Briot et al.

(10) Patent No.: US 7,705,193 B2
(45) **Date of Patent: *Apr. 27, 2010**

(54) PROCESS FOR IMPROVING GASOLINE FRACTIONS AND GASOIL CONVERSION WITH ADDITIONAL TREATMENT TO INCREASE THE GASOIL FRACTION YIELD

(75) Inventors: Patrick Briot, Pommier de Beaurepaire (FR); Arnaud Baudot, Lyons (FR); Vincent Coupard, Vaulx en Velin (FR); Stéphane Morin, Rueil Malmaison (FR); Alain Methivier, Marly le Roi (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 1201 days.

This patent is subject to a terminal disclaimer.

(21) Appl. No.: 11/144,740

(22) Filed: Jun. 6, 2005

(65) Prior Publication Data

US 2006/0009670 A1 Jan. 12, 2006

(30) Foreign Application Priority Data

Jun. 4, 2004 (FR) ..... 04 06097

(51) Int. Cl.
*C07C 2/02* (2006.01)

(52) U.S. Cl. ..... 585/502; 585/324; 585/326; 585/327; 585/329; 585/330; 585/518; 585/533; 585/535; 210/651; 210/774; 210/805; 210/806; 203/28; 203/39

(58) Field of Classification Search ..... 585/324, 585/326, 327, 329, 330, 444, 502, 518, 533, 585/535; 210/640, 651, 806, 774, 805; 203/28, 203/39

See application file for complete search history.

(56) References Cited

U.S. PATENT DOCUMENTS

| | | | | |
|---|---|---|---|---|
| 4,677,237 | A * | 6/1987 | Imai et al. | 585/444 |
| 5,591,345 | A * | 1/1997 | Engelen et al. | 210/640 |
| 6,051,517 | A * | 4/2000 | Funke et al. | 502/4 |
| 2003/0171632 | A1 | 9/2003 | DuToit | |
| 2004/0033370 | A1 | 2/2004 | Chau et al. | |

FOREIGN PATENT DOCUMENTS

| | | | |
|---|---|---|---|
| DE | 3030998 | A1 | 4/1982 |

* cited by examiner

*Primary Examiner*—In Suk Bullock
*Assistant Examiner*—Prem C. Singh
(74) *Attorney, Agent, or Firm*—Millen, White, Zelano, Branigan, P.C.

(57) ABSTRACT

The invention relates to a process for conversion of a gasoline-range hydrocarbon feed into a gasoline fraction with a higher octane rating than that of the feedstream, and a gasoil fraction with a cetane number higher than 45, including the following steps: a) a membrane separation step (B) applied to the hydrocarbon feed under conditions enabling selective separation of the majority of the linear olefins present in said feed and constituting the β fraction, the fraction containing the majority of the branched olefins, termed the γ fraction, constituting a gasoline with a high octane rating, greater than that of the feed; b) an oligomerisation step (C) applied to the linear olefins (β fraction) contained in the effluent stream from the membrane separation step (B) under moderate oligomerisation conditions; c) a distillation separation step (D) applied to the effluent stream arising from the oligomerisation step in at least two fractions; d) a hydrogenation step (E) applied to one of the fractions obtained at step c).

15 Claims, 1 Drawing Sheet

PROCESS FOR IMPROVING GASOLINE FRACTIONS AND GASOIL CONVERSION WITH ADDITIONAL TREATMENT TO INCREASE THE GASOIL FRACTION YIELD

FIELD OF THE INVENTION

The present invention relates to a process for enabling the respective production of gasoline and gasoil to be controlled in a simple and economic manner. More precisely, in the process that is the subject of this application, it is possible to convert an initial hydrocarbon feed within the gasoline range, including between 4 and 15 carbon atoms and preferably between 4 and 11 carbon atoms, into a gasoline fraction having an improved octane rating relative to the feed, and a gasoil fraction with a high cetane rating.

This application offers an improvement on the application entitled "Process for improving gasoline fractions and gasoil conversion" by the same inventors and filed on the same day as the present application.

The effects of this improvement relate to the yield of the gasoil fraction obtained, the octane rating of the gasoline fraction obtained, and also to the fact that the initial gasoline fraction can be of absolutely any composition provided that the number of carbon atoms is within the requisite range.

It is known ("Carburants et Moteurs" by J. C. Guibet, Edition Technip, Volume I (1987)) that the chemical nature of the olefins contained in gasolines contributes greatly to the octane rating of said gasolines. For this reason, olefins can be classified into two separate categories:

branched olefins which have good octane ratings. This octane rating increases with the number of branches and decreases with the chain length.

linear olefins which have a low octane rating, this octane rating decreasing markedly with the chain length.

The object of the present invention is to produce, from any gasoline fraction, a gasoline fraction having an improved octane rating relative to the initial gasoline fraction, and a gasoil fraction having a cetane number at least equal to 45 and preferably higher than 50.

Furthermore, the effluents arising from conversion processes for more or less heavy residues, such as for example the gasoline fractions arising from the fluid catalytic cracking process (FCC), have an olefin content between 10 and 80%.

Said effluents are used in the composition of commercial gasolines at the rate of 20 to 40% depending on the geographical origin (27% in Western Europe and 36% in the USA).

It is probable that in the context of environmental protection, standards for commercial gasolines will be oriented in the coming years towards a reduction in permitted olefin levels in gasolines.

It is apparent from the foregoing considerations that the production of gasolines having a low olefins content but which retain an acceptable octane rating will only be possible by selecting a gasoline base composed of high octane branched olefins, either exclusively or in very high proportions.

One of the objects of the present invention is to separate the linear olefins from the branched olefins in an initial gasoline feed.

A further object of the present invention is to provide an alternative aimed at improving the flexible management of refinery products.

More precisely, use of the present process can make it possible to advantageously control the proportions of gasoline and gasoil obtained ex-refinery according to market demands.

EXAMINATION OF THE PRIOR ART

Various processes are known for the conversion of olefins with a view to increasing their octane rating.

For example, these include aliphatic alkylation between paraffins and olefins to produce high octane gasoline fractions. This process can use mineral acids such as sulphuric acid (Symposium on Hydrogen Transfer in Hydrocarbon Processing, 208$^{th}$ National Meeting, American Chemical Society-August 1994), solvent-soluble catalysts (EP 0714871) or heterogeneous catalysts (U.S. Pat. No. 4,956,518).

By way of example, processes of addition to isobutane of alkenes with between 2 and 5 carbon atoms give rise to highly branched molecules with between 7 and 9 carbon atoms, and generally characterised by high octane ratings.

Other conversions are known that implement processes of etherification of branched olefins, such as for example those described in U.S. Pat. No. 5,633,416 and EP 0451989. These processes are used to produce ethers of the type MTBE (methyl tert butyl ether), ETBE (ethyl tert butyl ether) and TAME (tert amyl methyl ether), which are well known octane-enhancing components of gasolines.

In a third process pathway, oligomerisation processes based essentially on dimerisation and trimerisation of light olefins arising from the catalytic cracking process and having between 2 and 4 carbon atoms, are used to produce gasoline or distillate fractions. An example of such a process is described in the patent EP 0734766.

This process mainly yields products having 6 carbon atoms when the olefin used is propylene, and 8 carbon atoms when the olefin is linear butene.

These oligomerisation processes are known to yield gasoline fractions having good octane ratings, but when they are conducted in conditions favouring the formation of heavier fractions, they generate gasoil fractions with very low cetane rating.

Such examples are also illustrated by U.S. Pat. No. 4,456,779 and U.S. Pat. No. 4,211,640.

U.S. Pat. No. 5,382,705 proposes to link the oligomerisation and etherification previously described so as to produce, from a $C_4$ fraction, tertiary alkyl ethers such as MTBE or ETBE and lubricants.

BRIEF DESCRIPTION OF THE INVENTION

The invention relates to a process for conversion of a hydrocarbon feed containing 4 to 15 carbon atoms and preferably 4 to 11 carbon atoms, and having any composition of paraffins, olefins and aromatics, said process including the following steps:

a membrane separation step for the hydrocarbon feed ($\alpha$ fraction) in conditions enabling selective separation of the majority of the linear olefins present in said feed ($\beta$ fraction), the fraction containing the majority of the branched olefins ($\gamma$ fraction) constituting a gasoline with a high octane rating, i.e. higher than that of the feed, a treatment step for the linear olefins contained in the effluent stream from the membrane separation step ($\beta$ fraction) under moderate oligomerisation conditions, a distillation separation step for the effluent stream arising from the oligomerisation step in at least two fractions:

a light fraction termed the $\delta$ fraction, including hydrocarbons whose end boiling point is below a temperature between 150° C. and 200° C., a heavy fraction termed the $\eta$ fraction, including hydrocarbons whose initial boiling point is above a temperature between 150° C. and 200° C., a hydrogenation step for the η fraction under conditions designed to obtain a gasoil with a high cetane number, i.e. at least equal to 45, and preferably above 50.

a dehydrogenation step (F) for the light fraction δ arising from the distillation separation step, and producing a fraction μ which is at least partially recycled to the inlet of the membrane separation step.

optionally, a selective hydrogenation step (G) for the μ fraction producing a fraction λ which is at least partially recycled to the input of the membrane separation step.

In a first variant of the process, the δ fraction arising from the distillation separation step and including the majority of the linear paraffins and part of the linear olefins, is fed directly into a gasoline catalytic reforming unit that is assumed to exist at the production site.

In another variant of the invention, the μ fraction arising from the dehydrogenation unit (F) is at least partially recycled to the input of the membrane separation unit (B), the other part of said μ fraction being sent in a mixture with the γ fraction to form a high octane gasoline.

In another variant of the invention, the λ fraction arising from the hydrogenation unit (G) is not fully recycled to the input of the membrane separation unit (B), at least part is mixed with the γ fraction to form a high octane gasoline.

In a general manner, within the context of the invention, the oligomerisation step is conducted at a pressure between 0.2 and 10 MPa, with a ratio of feed volume flow to catalyst volume (termed hourly volume rate—HSV) between 0.05 and 50 litres/litre-hour, and at a temperature between 15° C. and 300° C.

The oligomerisation step is generally conducted in the presence of a catalyst including at least one metal from periodic table group VIB.

The separation step for linear olefins and paraffins on one hand, and for branched olefins and paraffins on the other hand, is conducted in a so-called membrane separation unit which can utilise a wide variety of membrane types, the invention not being in any way tied to a particular type of membrane.

Membranes suitable for use within the framework of the invention are preferably membranes used in nanofiltration and reverse osmosis (membranes included in the category of membranes for filtration processes) or membranes used in gas phase permeation or pervaporation (membranes included in the category of membranes for permeation processes).

In terms of materials, these membranes can be either zeolitic type membranes, or polymer (or organic) type membranes, or ceramic (or mineral) type membranes, or of the composite type in the sense that they can be composed of a polymer and at least one mineral compound.

Membranes suitable for use in the process object of the invention can also be film-based membranes. For example, the latter category can include film-based membranes formed from molecular sieves, or film-based membranes formed from molecular sieves based on silicates, aluminosilicates, aluminophosphates, silicoaluminophosphates, metallo-aluminophosphates, stanosilicates, or a mixture of at least one of these two types of constituents.

With regard to zeolite-based membranes, these can more particularly include zeolite-based membranes of the type MFI or ZSM-5, either in native form or subjected to ion-exchange with H+; Na+; K+; Cs+; Ca+; Ba+ ions, and zeolite-based membranes of the type LTA.

In some cases, the process according to the invention can include a step for the removal of at least part of the nitrogenous or basic impurities contained in the initial hydrocarbon feedstream.

Generally, the initial hydrocarbon feed will be produced from a catalytic cracking, thermal cracking or paraffin dehydrogenation process. It can be introduced into the process object of the present invention, either by itself or mixed with other feedstocks.

BRIEF DESCRIPTION OF DRAWING

The invention will be better understood by reference to FIG. 1 which is a schematic diagram of a process according to the invention and in which the optional units are indicated by a dotted line, the other units indicated by a solid line being obligatory.

DETAILED DESCRIPTION

Figure 1:
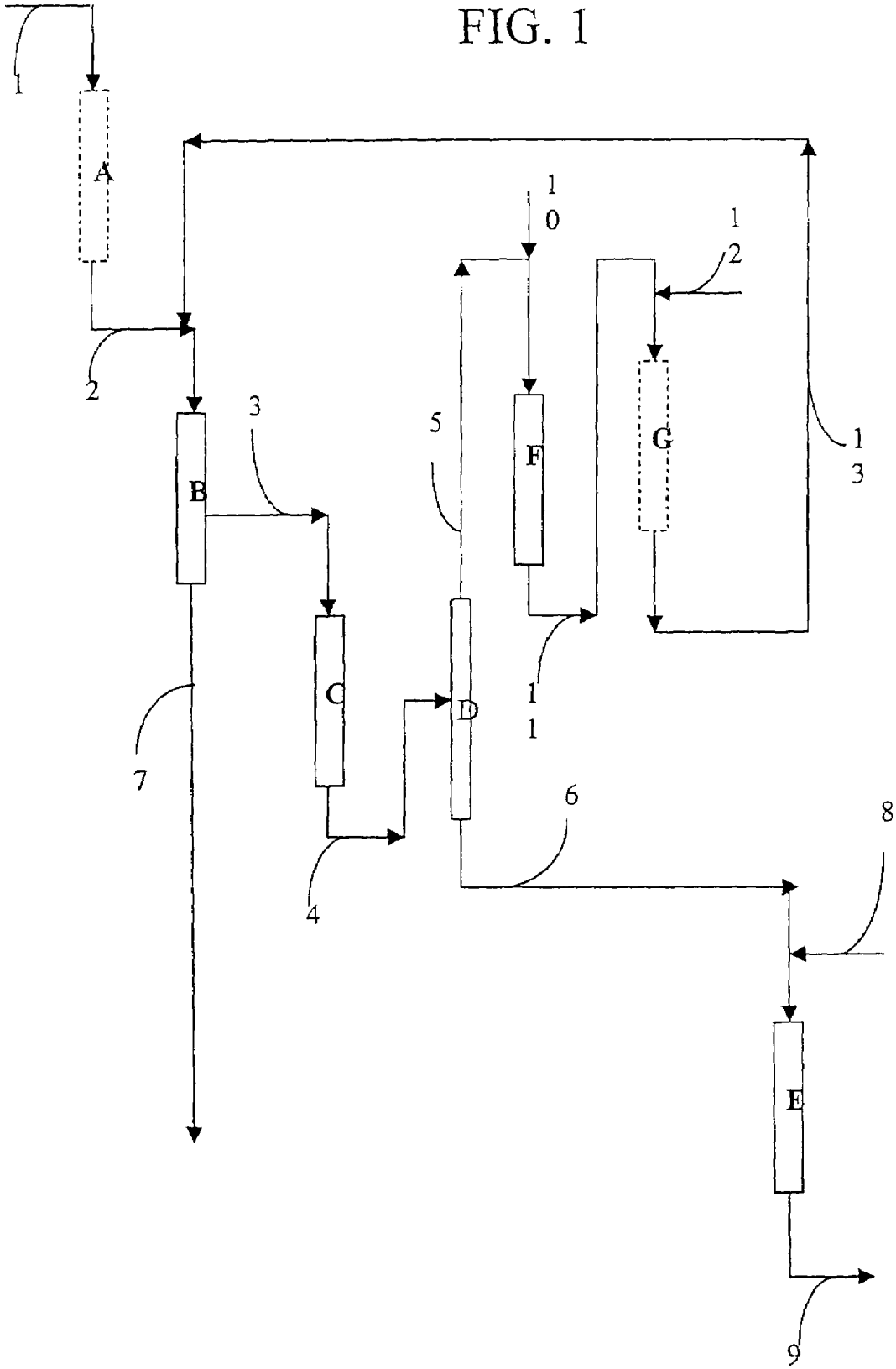

In FIG. 1, the hydrocarbon feedstream is routed via line 1 to a purification unit A.

This unit A serves to remove a large proportion of the nitrogenous and/or basic compounds contained in the feed. This removal, although optional, is necessary when the feedstream includes a high proportion of nitrogenous and/or basic compounds, as these compounds are poisonous for the catalysts used in the subsequent steps of the process.

Said compounds can be removed by adsorption on a solid acid. This solid can be chosen from the group composed of silicoaluminates, titanosilicates, mixed alumina and titanium oxides, clays, and resins.

The solid can also be selected from mixed oxides obtained by grafting at least one organometallic, organosoluble or water-soluble compound, at least one element chosen from the group composed of titanium, zirconium, silicon, germanium, tin, tantalum and niobium, onto at least one oxide support such as alumina (gamma, delta, eta forms, alone or mixed), silica, the alumina silicas, titanium silicas, zirconium silicas, ion exchange resins of the Ambetlyst type, or any other solid that has any acidity.

A particular embodiment of the invention can consist in using a mixture of at least two of the catalysts previously described.

The pressure of the feedstock purification unit (A) is between atmospheric pressure and 10 MPa, preferably between atmospheric pressure and 5 MPa, and preferably a pressure will be chosen at which the feedstock is in the liquid state.

The ratio of the feedstock volume flowrate to the volume of catalytic solid (also termed hourly space velocity—HSV) is typically between 0.05 litre/litre-hour and 50 litres/litre-hour, preferably between 0.1 litre/litre-hour and 20 litres/litre-hour), and even more preferably between 0.2 litre/litre-hour and 10 litres/litre-hour.

The temperature of the purification unit (A) is between 15° C. and 300° C., preferably between 15° C. and 150° C., and even more preferably between 15° C. and 60° C.

The removal of nitrogenous and/or basic compounds contained in the feedstock can also be accomplished by washing in an aqueous acid solution, or by any equivalent means known to the person skilled in the art.

The purified feedstock termed the α fraction is routed via line 2 to the membrane separation unit (B). In unit (B), the linear olefins and paraffins forming the β fraction are separated by a membrane from the rest of the gasoline fraction (forming the γ fraction), and are fed via line 3 to the inlet of an oligomerisation unit (C).

The fraction stripped of linear olefins and paraffins is taken off unit (B) via line 7. This fraction termed the γ fraction, in which the content of linear olefins is notably reduced as it principally contains only branched olefins, has an enhanced octane rating relative to the initial gasoline fraction or α fraction.

More particularly, any type of membrane capable of separating the linear paraffins and olefins on one hand, and the branched paraffins and olefins on the other hand, can be used, whether they be organic or polymer membranes (for example, the PDMS 1060 membrane by Sulzer Chemtech Membrane Systems), ceramic or mineral membranes (composed for example at least partially of zeolite, silica, alumina, glass or carbon), or composites composed of a polymer and at least one mineral or ceramic compound (for example, the PDMS 1070 membrane by Sulzer Chemtech Membrane Systems).

Numerous sources in the literature make reference to film-based membranes formed from molecular sieves, such as MFI zeolites, which provide a highly effective means of separating linear paraffins from branched paraffins by virtue of a diffusional selectivity mechanism.

All types of MFI zeolite-based membranes, whether they be silicalite-based membranes or fully dealuminated MFI zeolite-based membranes, exhibit normal/iso paraffin selectivity and can therefore be used for the purposes of the present invention.

These MFI zeolites include those described in the following articles or papers:

van de Graaf, J. M., van der Bijl, E., Stol, A., Kapteijn, F., Moulijn, L A., in *Industrial Engineering Chemistry Research,* 37, 1998, 4071-4083;

Gora, L., Nishiyama, N., Jansen, J. C., Kapteijn, F., Teplyakov, V., Maschmeyer, Th., in *Separation Purification Technology,* 22-23, 2001, 223-229;

Nishiyama, N., Gora, L., Teplyakov, V., Kapteijn, F., Moulijn, J. A., in *Separation Purification Technology,* 22-23, 2001, 295-307.

Native ZSM-5 zeolite-based membranes are described in the following papers:

Coronas, J., Falconer, J. L., Noble, R. D., in *AIChE Journal,* 43, 1997, 1797-1812;

Gump, C. J, Lin, X., Falconer, J. L., Noble, R. D., in *Journal of Membrane Science,* 173, 2000, 35-52.

Finally, membranes subjected to ion exchange with type H+, Na+, K+, Cs+, Ca+ or Ba+ ions are referenced by Aoki, K., Tuan, V. A., Falconer, J. L, Noble, R. D., in *Microporous Mesoporous Materials,* 39, 2000, 485-492.

Published values for n-C4/i-C4 mixture selectivity obtained with this type of membrane range between 10 and 50 depending on the operating conditions. This aspect is referenced in the paper by van de Graaf, J. M., van der Bijl, E., Stol, A., Kapteijn, F., Moulijn, J. A., in *Industrial Engineering Chemistry Research,* 37, 1998, 4071-4083.

Separation selectivities observed with MFI zeolite-based membranes applied to n-hexane/dimethylbutane separation are even higher:

200 to 400 as cited in the paper by Coronas, J., Noble, R. D., Falconer, J. L., in *Industrial Engineering and Chemical Research,* 37, 1998, 166-176;

100 to 700 (Gump, C J., Noble, R. D., Falconer, J. L., in *Industrial Engineering and Chemical Research,* 38, 1999, 2775-2781;

600 to over 2000 (Keizer, K., Burggraaf, A. J., Vroon, Z. A. E. P., Verweij, H., in *Journal of Membrane Science,* 147, 1998, 159-172.

The selectivity of this type of membrane is essentially based on a difference in diffusivity between linear compounds, which diffuse more rapidly as they offer a substantially smaller kinetic diameter than the diameter of the zeolite micropores, and branched compounds, which diffuse more slowly as they present a kinetic diameter close to that of the micropores.

Given that paraffins and their branched or linear olefinic homologues have very similar kinetic diameters, MFI zeolite-based membranes also provide high normal/iso olefin selectivities, close to those observed for normal/iso paraffins in similar operating conditions.

The use of type LTA structural zeolite-based membranes can also be envisaged, this zeolite exhibiting very good form selectivity vis-à-vis normal paraffins.

The working temperature of the membrane will be between ambient temperature and 400° C., and preferably between 80° C. and 300° C.

The linear olefins and paraffins (β fraction) separated from the gasoline fraction in unit B are sent to an oligomerisation reactor, denoted unit C, via line 3.

This unit C contains an acid catalyst. The hydrocarbons present in the mixture of linear paraffins and olefins will undergo moderate oligomerisation reactions, i.e. generally dimerisation or trimerisation reactions, the reaction conditions being optimised for the production of a majority of hydrocarbons in which the carbon number is for the most part between 9 and 25, and preferably between 10 and 20.

The catalyst for unit C can be chosen from the group comprising silicoaluminates, titanosilicates, alumina titanium mixtures, clays, resins, mixed oxides obtained by grafting at least one organo-metallic, organo-soluble or water-soluble (chosen from the group comprising alkys and/or alcoxys, metals having at least one element such as titanium, zirconium, silicon, germanium, tin, tantalum, niobium) onto an oxide support such as alumina (gamma, delta, eta forms, alone or mixed), silica, alumina silicas, titanium silicas, zirconium silicas, or any other solid that has any acidity.

Preferably, the catalyst used to conduct the oligomerisation process includes at least one metal from periodic table group VIB, and advantageously an oxide of said metal. Said catalyst can additionally include an oxide support chosen from the group comprising aluminas, titanates, silicas, zirconium oxides, and alumino-silicates.

A particular embodiment of the invention can consist in using a physical mixture of at least two of the catalysts cited previously.

The pressure in unit C is typically such that the feedstock is in liquid form. This pressure is in principle between 0.2 MPa and 10 MPa, preferably between 0.3 and 6 MPa, and even more preferably between 0.3 and 4 MPa. The ratio of feedstock volume flowrate to catalyst volume (also termed hourly space velocity or HSV) can be between 0.05 litre/litre-hour and 50 litres/litre-hour, preferably between 0.1 litre/litre-hour and 20 litres/litre-hour, and even more preferably between 0.2 litre/litre-hour and 10 litres/litre-hour.

The applicant found that, under the foregoing conditions of pressure and HSV, the reaction temperature must be between 15° C. and 300° C., preferably between 60° C. and 250° C., and more particularly between 100° C. and 250° C. in order to optimise the quality of the products obtained.

The effluent stream arising from unit (C) is then routed via line 4 to one or more distillation columns referenced on the flow diagram in FIG. 1 as unit (D).

Unit (D) can also be a flash drum or any other means known to the person skilled in the art allowing the effluent stream to be separated into at least two fractions differentiated by their initial boiling point:

a so-called light fraction δ having a final distillation point between approximately 150° C. and approximately 200° C., preferably between 150° C. and 180° C.

a so-called heavy fraction η having an initial boiling point between approximately 150° C. and approximately 200° C., preferably between 150° C. and 180° C. This fraction is transferred via line 6 to unit (E).

The heavy fraction η is a fraction of which the initial point corresponds to a gasoil fraction.

This fraction is composed for the most part of olefins and diolefins resulting from the polymerisation of linear olefins. This fraction can be hydrogenated in a conventional hydrogenation unit in the presence of a catalyst and in operating conditions well known to the person skilled in the art. These olefins are then transformed into linear paraffins. The effluent stream from the hydrogenation unit (E) is a gasoil with cetane number greater than 45 and preferably greater than 50.

The δ fraction is mainly composed of linear paraffins that are non reactive during the oligomerisation reaction. This fraction, carried via line 5, is mixed with hydrogen carried via line 10, and injected into a dehydrogenation unit (F).

Water or any other compound capable of decomposing in water under dehydrogenation conditions may be added to the feedstream. The quantity of water present in the hydrocarbon feed (this water can be generated by the breakdown of another compound, such as for example an alcohol, an aldehyde, a ketone, an ether), will be between 1 and 10000 ppm by weight of water relative to the hydrocarbon feed.

The dehydrogenation unit (F) operates in temperature conditions between 400° C. and 520° C., preferably between 450° C. and 490° C.

The working pressure range of the dehydrogenation unit (F) is between 0.05 MPa and 1 MPa, preferably between 0.1 MPa and 0.5 MPa.

The ratio of feedstock volume flowrate to catalyst volume is between 1 $h^{-1}$ and 500 $h^{-1}$, preferably between 15 $h^{-1}$ and 300 $h^{-1}$. The molar ratio of hydrogen to hydrocarbon is between 1 and 20 moles/mole, and preferably between 4 and 12 moles/mole.

The dehydrogenation catalyst in unit (F) can be chosen from catalysts known to the person skilled in the art for the dehydrogenation of short paraffins from C2 to C5 or long normal paraffins from C10 to C14. The catalyst is thus composed of a metallic phase carried on a support of which the specific surface is advantageously between 5 and 300 $m^2/g$.

This catalyst support includes at least one refractory oxide that is generally chosen from metal oxides in groups IIA, IIIA, IIIB, IVA or IVB of the periodic table of elements, such as for example oxides of magnesium, aluminium, silicon, zirconium, taken alone or mixed with each other, or mixed with oxides of other elements in the periodic table. Carbon can also be used.

The catalyst for the dehydrogenation unit (F) contains in addition to this support:

at least one group VIII metal chosen from iridium, nickel, palladium, platinum, rhodium and ruthenium. Platinum will generally be the preferred metal. The percentage by weight is chosen between 0.01 and 5%, and preferably between 0.02 and 1%.

at least one additional element chosen from the group comprising germanium, tin, lead, rhenium, gallium, iron, indium and thallium. The percentage by weight is chosen between 0.01% and 10%, and preferably between 0.02% and 5%. Advantageously in certain cases, at least two metals from this group can be used at the same time.

Optionally, the dehydrogenation catalyst for unit (F) can also contain a sulphur compound, having a content by weight of the sulphur element generally between 0.005 and 1% relative to the catalyst mass.

The catalyst for unit (F) can also contain one or more additional elements conventionally designed to limit the acidity of the support, such as alkalines or alkaline-earths, with a percentage by weight of 0.01% to 3%.

It can also contain between 0.01% and 3% of a halogen or halogenated compound.

The quantities of these alkaline and/or alkaline-earth compounds on one hand, and halogenated compounds on the other hand, can be adjusted so as to modify the content of alkyl-aromatic compounds and/or branched paraffins formed during the dehydrogenation reaction.

These compounds are in effect successive products of the dehydrogenation reaction of the paraffins treated in this process.

It is known that aromatic compounds and branched paraffins have a much better octane rating than linear paraffins. As these products are not affected by the selective hydrogenation step, their production at the dehydrogenation step (F) will serve to enrich the gasoline fraction (taken off via line (7)) after the membrane separation step (B).

Thus, the gasoil fraction will for example be favoured by the use of a dehydrogenation catalyst containing between 0.01% and 3% of at least one alkaline and/or alkaline-earth and less than 0.2% of a halogenated compound.

In a first variant, the proportion of aromatic compounds arising from this dehydrogenation step can also be minimised by judicious selection of the operating conditions, known to the person skilled in the art. The use of a high ratio of feedstock flowrate to catalyst volume (HSV), or a high H2/HC ratio serves to limit the formation of aromatics at the dehydrogenation step (F). An HSV value between 15 and 300 $h^{-1}$, and a H2/HC value between 4 and 12 will be generally preferred.

The gasoline fraction will for example be favoured by the use of a dehydrogenation catalyst containing between 0.1% and 3% of a halogenated compound, and less than 0.5% of an alkaline and/or alkaline-earth. In certain cases the catalyst need not contain an alkaline or alkaline-earth metal.

In a second variant, the proportion of aromatic compounds arising from the dehydrogenation step (F) can also be optimised by a judicious choice of operating conditions, known to the person skilled in the art. The use of a low ratio of feedstock flowrate to catalyst volume (HSV) serves for example to increase the formation of aromatics vis-à-vis the formation of olefins. An HSV value between 1 and 50 $h^{-1}$ will in this case generally be preferred.

In unit (F), the dehydrogenation of paraffins to olefins is also accompanied, in addition to the formation of aromatic compounds and branched paraffins, by the formation of diolefins and possibly other unsaturated compounds such as alkynes or triolefins.

The formation of diolefins is strongly influenced by the thermodynamic equilibrium between paraffins/olefins/diolefins.

The effluent stream from unit (F) taken off via line (11) is mixed with a hydrogen feed via line (12) and then routed to a selective hydrogenation unit (G) the purpose of which is to remove small quantities of diolefins and any alkynes and triolefins by hydrogenation, without affecting the olefins and aromatic compounds formed in unit (F). This selective hydrogenation operates in pressure ranges between 1 MPa and 8 MPa, and preferably between 2 MPa and 6 MPa. The temperature is between 40° C. and 350° C., and preferably between 40° C. and 250° C.

The ratio of feedstock volume flowrate to catalyst volume (HSV) is between 0.5 and 10 $m^3/m^3$-hour and preferably between 1 and 5 $m^3/m^3$-hour.

The catalyst for the hydrogenation unit (G) is composed of a silica or alumina based support on which is deposited a metal such as nickel, platinum or palladium. The catalyst for the hydrogenation unit (G) can also be composed of mixtures of nickel and molybdenum or mixtures of nickel and tungsten.

At the outlet from the selective hydrogenation step (G), the effluent stream from unit (G) contains for the most part linear paraffins, olefins and aromatics. This fraction, termed the λ fraction, is then wholly or partially recycled via line (13) to the inlet of unit (B).

EXAMPLES

The following examples will serve to illustrate the advantages presented by the present invention.

Example 1 corresponds to the invention and will be better understood by reference to FIG. 1.

Example 2 is a comparative example.

Example 1

According to the Invention

In this example, the feedstream is an FCC gasoline with a boiling point between 40° C. and 150° C. This gasoline contains 10 ppm of nitrogen.

The feedstream is routed to a purification reactor A containing a solid composed of a mixture of 20% alumina and 80% by weight of mordenite type zeolite. The zeolite used in this example has a silicon/aluminium ratio of 45.

The pressure of the purification unit is 0.2 MPa.

The ratio of feedstock liquid volume flowrate to solid acid volume (HSV) is 1 litre/litre-hour. The reactor temperature is 20° C.

Table 1 gives the composition of the initial feedstream and that of the effluent stream arising from unit A (α fraction). A feedstock flowrate of 1 kg/h is used.

TABLE 1

Unit A feed and effluent stream characteristics.

| | Unit A feed | Unit A effluent |
|---|---|---|
| Nitrogen (ppm) | 10 | 0.2 |
| Paraffins (wt %) | 25.2 | 25.1 |
| Naphthenes (wt %) | 9.6 | 9.8 |
| Aromatics (wt %) | 34.9 | 35 |

The unit A effluent stream (α fraction) is then sent to a membrane reactor B composed of an α-alumina based support on which is deposited a layer of MFI zeolite to a thickness between 5 and 15 μm.

The pressure of the membrane reactor B is 0.1 MPa and the temperature is 150° C.

Table 2 gives the composition of the effluent stream arising from unit B (β fraction and γ fraction).

TABLE 2

Step B effluent stream characteristics (before recycling).

| | β fraction | γ fraction |
|---|---|---|
| Yield (%) (relative to α fraction) | 8.8 | 91.2 |
| Production (g/h) | 88 | 912 |
| Paraffins (wt %) | 45.5 | 23.1 |

TABLE 2-continued

Step B effluent stream characteristics (before recycling).

| | β fraction | γ fraction |
|---|---|---|
| Naphthenes (wt %) | | 10.7 |
| Aromatics (wt %) | | 38.5 |
| Olefins (wt %) | 54.5 | 27.7 |

The β fraction arising from the membrane separation unit is injected into an oligomerisation reactor (C) containing a catalyst composed of a mixture of 50% by weight of zirconium oxide and 50% by weight of $H_3PW_{12}O_{40}$.

The pressure of the unit is 2 MPa, and the ratio of feedstock volume flowrate to catalyst volume (HSV) is 1.5 litres/litre-hour. The temperature is set at 170° C.

An effluent stream is obtained at the reactor outlet from the oligomerisation unit (C) which is then separated into two fractions by means of a distillation column (D): a light fraction δ, and a heavy fraction η having the compositions and yields as detailed in Table 3 below:

TABLE 3

Production and composition of fractions δ and η

| | δ fraction | η fraction |
|---|---|---|
| Production (g/h) | 39.6 | 48 |
| Paraffins (%) | 100 | |
| Olefins (%) | | 100 |

The heavy fraction η is sent to a hydrogenation reactor (E) containing a catalyst including an alumina support onto which nickel and molybdenum are deposited (marketed by AXENS under the trade name HR348, which is a registered trademark).

The pressure of the unit is 5 MPa, and the ratio of feedstock volume flowrate to catalyst volume (HSV) is 2 litres/litre-hour.

The volume ratio of injected hydrogen to feedstock is 600 litres/litre.

The reactor temperature is 320° C.

The characteristics of the effluent stream arising from step (E), which are those of a gasoil, are given in Table 4.

TABLE 4

Unit E effluent stream characteristics.

| | Unit E effluent |
|---|---|
| Density at 20° C. (kg/l) | 0.787 |
| Sulphur (ppm) | 1 |
| Motor cetane | 55 |

The light fraction δ of distillation interval 40° C.-200° C. arising from the distillation step (D) is mixed with hydrogen with a hydrogen to hydrocarbon molar ratio of 6 moles/mole, then sent to the dehydrogenation unit (F).

The total pressure of the dehydrogenation unit (F) is 0.3 MPa, and the temperature is 475° C. The ratio of feed volume flowrate to catalyst volume (HSV) is 20 litres/litre-hour. The catalyst used in dehydrogenation unit (F) is marketed by the company AXENS under the reference DP 805, which is a registered trademark.

The composition of the μ fraction arising from dehydrogenation unit (F) or μ fraction is given in Table 5 and compared with the dehydrogenation unit (F) feed or δ fraction.

TABLE 4

Unit F effluent stream characteristics (μ fraction).

| | δ fraction | μ fraction |
|---|---|---|
| Linear paraffins (wt %) | 100 | 85.1 |
| Branched paraffins (wt %) | | 0.3 |
| Olefins (wt %) | | 12 |
| Aromatics (%) | | 2 |
| Diolefins (wt %) | | 0.6 |

This μ fraction is mixed with hydrogen and sent to a hydrogenation reactor (G) containing a catalyst marketed by the company AXENS under the reference LD 265, which is a registered trademark.

The pressure of the unit is 2.8 MPa, the temperature is 90° C., and the ratio of feed volume flowrate to catalyst volume (HSV) is 3 litres/litre-hour.

The composition of the λ fraction resulting from this selective hydrogenation (G) is compared with that of the μ fraction in Table 6.

TABLE 5

Unit G effluent stream characteristics (λ fraction).

| | μ fraction | λ fraction |
|---|---|---|
| Linear paraffins (wt %) | 85.1 | 85.2 |
| Branched paraffins (wt %) | 0.3 | 0.3 |
| Olefins (wt %) | 12 | 12.5 |
| Aromatics (%) | 2 | 2 |
| Diolefins (wt %) | 0.6 | 0 |

This λ fraction is wholly recycled to the inlet of the membrane reactor (B).

The linear paraffins and olefins are thus contained in the new β fraction obtained after recycling and thereby serve to increase the gasoil yield.

The properties of the γ fraction thus obtained are presented in Table 6 and compared with those of the initial α fraction.

TABLE 6

Comparison of initial α fraction and final γ fraction characteristics.

| | α fraction | final γ fraction |
|---|---|---|
| Paraffins (wt %) | 25.2 | 22.9 |
| Naphthenes (wt %) | 9.6 | 10.4 |
| Aromatics (%) | 34.9 | 37.8 |
| Olefins (wt %) | 30.3 | 27.6 |
| RON octane number | 92 | 97 |

The present process makes it possible to obtain, from an FCC gasoline cut, a gasoline fraction (γ fraction) having an improved octane rating relative to that of the initial cut (97 against 92) and a gasoil fraction, being the effluent stream from unit (E), with a high cetane number (55), perfectly suitable for marketing to European and US specifications.

Example 2

Comparative

Example 2 corresponds to the prior art and consists in sending an FCC gasoline cut (fraction α) with a boiling point between 40° C. and 150° C. directly to an oligomerisation unit (C).

This gasoline contains 10 ppm nitrogen.

The feedstream is routed to a purification reactor A containing a solid composed of a mixture of 20% alumina and 80% by weight of mordenite type zeolite. The zeolite used in this example has a silicon/aluminium ratio of 45.

The pressure of the purification unit is 0.2 MPa.

The liquid feed volume to solid acid volume ratio (HSV) is 1 litre/litre-hour. The reactor temperature is 20° C.

Table 7 gives the composition of the initial feed and that of the effluent stream from unit A. A feedstock flowrate of 1 kg/h is used.

TABLE 7

Unit A feed and effluent stream characteristics.

| | Unit A feed | Unit A effluent |
|---|---|---|
| Nitrogen (ppm) | 10 | 0.2 |
| Paraffins (wt %) | 25.2 | 25.1 |
| Naphthenes (wt %) | 9.6 | 9.8 |
| Aromatics (wt %) | 34.9 | 35 |
| Olefins (wt %) | 30.3 | 30.1 |

The unit A effluent stream (α fraction) is sent to an oligomerisation unit (C) with the operating conditions as described in example 1.

At the outlet from the oligomerisation step (C), the effluent stream from oligomerisation unit (C) is separated into 2 fractions by means of the distillation column (D):

a light fraction δ' with the distillation interval 40° C.-200° C. obtained with a yield by weight of 70%, a heavy fraction η' including hydrocarbons with an initial distillation point over 200° C., obtained with a yield by weight of 30%.

The heavy fraction η' is sent to a hydrogenation reactor (E) containing an alumina-based catalyst on which nickel and molybdenum are deposited.

The pressure of unit (E) is 5 MPa, the feed volume flowrate to catalyst volume ratio (HSV) is 2 litres/litre-hour. The injected hydrogen to feedstock volume ratio is 600 litres/litre.

The reactor temperature of unit (E) is 320° C. The characteristics of the effluent arising from unit (E), which are those of a gasoil, are presented in Table 8.

TABLE 8

Unit E effluent stream characteristics.

| | Unit E effluent |
|---|---|
| Density at 20° C. (kg/l) | 0.787 |
| Sulphur (ppm) | 1 |
| Motor cetane number | 35 |

It is seen that the cetane number of the gasoil obtained when oligomerisation is performed without pre-separating the linear compounds from the branched compounds is appreciably lower than that obtained in example 1 according to the invention.

The gasoil obtained by the process in example 2 is unsuitable for marketing, which is not the case with that obtained in example 1 according to the invention.

Similarly, the final gasoline fraction δ' has an octane rating of 85, lower than that obtained in example 1, which can render the marketing of this product problematic.

The properties of this gasoline fraction δ' are compared to those of the initial gasoline fraction (α fraction) in Table 9 below.

TABLE 9

Characteristics of fractions α and δ'

| | α fraction | δ' fraction |
|---|---|---|
| Production (g/l) | 1000 | 700 |
| Paraffins (wt %) | 25.2 | 36.2 |
| Naphthenes (wt %) | 9.6 | 13.7 |
| Aromatics (wt %) | 34.9 | 50.1 |
| Olefins (wt %) | 30.3 | |
| RON octane number | 92 | 85 |

The invention claimed is:

1. A process for conversion of a gasoline-range hydrocarbon feed, comprising 4 to 15 carbon atoms, into a gasoline fraction with a higher octane rating than that of the feedstream and a gasoil fraction with a cetane number higher than 45, the process including the following steps:

a) a membrane separation step (B) applied to the hydrocarbon feed under conditions enabling selective separation of the majority of the linear olefins present in said feed, termed β fractions, from the fraction containing the majority of the branched olefins, termed γ fraction constituting a gasoline with a high octane rating greater than that of the feed, b) an oligomerisation step (C) applied to the linear olefins (β fraction) contained in the effluent from the membrane separation step (B) under moderate oligomerisation conditions, c) a distillation separation step (D) applied to the effluent arising from the oligomerisation step in at least two fractions:

a δ fraction including hydrocarbons whose end boiling point is below a temperature between 150° C. and 200° C., a η fraction including hydrocarbons whose initial boiling point is above a temperature between 150° C. and 200° C., d) a hydrogenation step (E) applied to the η fraction to obtain a gasoil with a cetane number at least equal to 45, e) a dehydrogenation step (F) applied to said δ fraction to convert at least part of the paraffins into olefins, and to produce a fraction μ which is, at least partially, recycled to the inlet of the membrane separation step (B).

2. A process according to claim 1 wherein the μ fraction arising from the dehydrogenation step (F) undergoes selective hydrogenation (G) to remove the diolefins so as to produce a λ fraction which is recycled at least partially to the membrane separation step (B).

3. A process according to claim 1 wherein the μ fraction arising from the dehydrogenation step (F) applied to the δ fraction is mixed at least partially with the γ fraction arising from the membrane separation unit (B).

4. A process according to claim 2 wherein the δ fraction arising from the selective hydrogenation step (G) is at least partially mixed with the γ fraction arising from the membrane separation step (B).

5. A process according to claim 1 wherein the oligomerisation step (C) is conducted at a pressure between 0.2 and 10 MPa, with a volume ratio of feed flowrate to catalyst volume (HSV) between 0.05 and 50 liters/liter-hour, and at a temperature between 15° C. and 300° C., and in the presence of a catalyst including at least one metal in group VIB of the periodic table.

6. A process according to claim 1 wherein the membrane separation step is conducted with a membrane such as those used in nanofiltration or reverse osmosis, or gas phase permeation, or pervaporation processes.

7. A process according to claim 1 wherein the membrane separation unit comprises a film-based membrane formed from molecular sieves based on silicates, aluminosilicates, aluminophosphates, silicoalumino-phosphates, metallo-aluminophosphates, stanosilicates or a mixture of at least one of these two types of constituents.

8. A process according to claim 1 wherein the membrane separation unit comprises a membrane based on MFI or ZSM-5 type zeolite, in native form or subjected to ion exchange with H+; Na+; K+; Cs+; Ca+; Ba+ ions.

9. A process according to claim 1 wherein the membrane separation unit comprises a membrane based on type LTA zeolites.

10. A process according to claim 1 wherein the dehydrogenation catalyst in unit (F) is composed of a metallic phases deposited on a support, this support including at least one refractory oxide chosen from the metal oxides in groups IIA, IIIA, IIIB, IVA or IVB of the periodic table of elements.

11. A process according to claim 1 wherein the catalyst for unit (F) contains one or more additional elements chosen from the alkalines or alkaline-earths, with a percentage by weight between 0.01% and 3%.

12. A process according to claim 1 further including a step (A) for the removal of at least part of the nitrogenous or basic impurities contained in the initial hydrocarbon feed, this step (A) being located upstream of membrane separation unit (B).

13. A process according to claim 1 wherein the gasoline range-hydrocarbon feed is essentially devoid of hydrocarbons having less than 4 carbon atoms.

14. A process according to claim 1 wherein the gasoline range-hydrocarbon feed consists essentially of hydrocarbons having 4 to 15 carbon atoms.

15. A process according to claim 1 wherein the gasoline range-hydrocarbon feed consists of hydrocarbons having 4 to 15 carbon atoms.

* * * * *

UNITED STATES PATENT AND TRADEMARK OFFICE

CERTIFICATE OF CORRECTION

PATENT NO. : 7,705,193 B2
APPLICATION NO. : 11/144740
DATED : April 27, 2010
INVENTOR(S) : Patrick Briot It is certified that error appears in the above-identified patent and that said Letters Patent is hereby corrected as shown below:

Column 14, line 8 reads: "4. A process according to claim 2 wherein the δ fraction"

Should read: -- 4. A process according to claim 2 wherein the λ fraction --

Column 14, line 37 reads: "genation catalyst in unit (F) is composed of metallic phases"

Should read: -- genation catalyst in unit (F) is composed of metallic phase --

Signed and Sealed this
Twenty-eighth Day of December, 2010

David J. Kappos

David J. Kappos
*Director of the United States Patent and Trademark Office*